United States Patent [19]

Provence, Jr.

[11] Patent Number: 4,979,461

[45] Date of Patent: Dec. 25, 1990

[54] SELF RIGHTING TRAFFIC CONE

[76] Inventor: Albert M. Provence, Jr., 230 E. Pomona Ave., Monrovia, Calif. 91016

[21] Appl. No.: 336,680

[22] Filed: Apr. 12, 1989

Related U.S. Application Data

[63] Continuation-in-part of Ser. No. 317,131, Feb. 28, 1989, which is a continuation of Ser. No. 93,637, Sep. 8, 1987.

[51] Int. Cl.[5] ..... E01F 9/10

[52] U.S. Cl. ..... 116/63 C; 40/608; 40/612; 116/63 P; 248/910

[58] Field of Search ..... 40/606–608, 40/612; 116/63 R, 63 P, 63 C, 63 T; 248/160, 910; 404/10; D10/113; 446/325, 326, 396

[56] References Cited

U.S. PATENT DOCUMENTS 3,705,566 12/1972 Duckett et al. ..... 116/63 P

FOREIGN PATENT DOCUMENTS 2212194 7/1989 United Kingdom ..... 404/10

*Primary Examiner*—William A. Cuchlinski, Jr.
*Assistant Examiner*—W. Morris Worth
*Attorney, Agent, or Firm*—Cahill, Sutton & Thomas

[57] ABSTRACT

A normally upstanding road marker includes a cone extending from a special base formed of an elastomeric material to induce a self righting movement to return the road marker to an upstanding position subsequent to it having been tipped over. The base includes a peripheral edge of undulating configuration defining a plurality of radially extending flaps and an annular depression for focusing bending of the base along a line radially inwardly of at least some of the flaps.

6 Claims, 1 Drawing Sheet

SELF RIGHTING TRAFFIC CONE

REFERENCE TO RELATED APPLICATIONS

This is a continuation in part application of a copending application entitled "IMPROVED SELF RIGHTING ROAD MARKER", assigned Ser. No. 317,131, filed on Feb. 28, 1989, which is a continuation application of an application entitled "IMPROVED SELF RIGHTING ROAD MARKER", assigned Ser. No. 093,637, filed on Sep. 8, 1987, and describing an invention made by the present inventor.

BACKGROUND OF THE INVENTION

1. Field of the Invention:

The present invention relates to temporary road marking devices and, more particularly, to a road marker having self righting characteristics for returning it to an upright position subsequent to the application of an externally applied force.

2. Description of the Prior Art:

Road markers, or traffic cones as they are commonly referred to in the art, are in wide usage for temporarily delineating obstructions. Traditionally, traffic cones have been in the form of upstanding hollow cones with planar bases slightly larger than the bottom ends of the cones to provide a degree of stability. The traffic cones are normally fabricated of a brightly colored synthetic resin and are light in weight for portability and to yield in reaction to an externally applied force rather than to damage the striking object, such as a motor vehicle.

For these reasons, traditional traffic cones are easily tipped over by a striking vehicle and even by the wind. Due to the relatively small size of the base and the semi-rigid nature of the materials used in fabricating the traditional traffic cones, once they are tipped over they remain that way and can cause a hazardous situation due to the significant loss of visibility of the tipped over traffic cone.

As a result of the tipping problem, some attempts have been made to devise an acceptable traffic cone which is more resistant to tipping over in response to an externally applied tipping force. One attempt has been that of fabricating the cones with larger bases and/or weighted bases. Such traffic cones have not achieved any degree of commercial success due to a number of factors, such as the increased fabrication costs associated with weighting of the bases, the significant loss of portability and increased handling difficulties.

U.S. Pat. No. 3,792,679 suggests that a cone be fabricated of a material having elasticity and flexibility characteristics which would tend to cause the cone to be self righting; that is, that it would tend to return to an upright position after being tipped over. This particular structure failed to achieve any appreciable degree of commercial acceptance for the same basic reasons mentioned above. In order for this particular cone structure to work properly, the base had to be large enough to maintain a portion in contact with the ground surface at all times during tipping and self righting movements. In the absence of a maintained ground surface contact, the traffic cone would remain in a tipped over state and would not right itself. The added weight of the base to make it large enough to accomplish this result reduced the portability and ease of handling sufficiently to contribute to its lack of success.

Accordingly, a need exists for a traffic cone effective to right itself after being tipped.

SUMMARY OF THE INVENTION

A traffic cone for temporarily delineating obstructions, such as road repair work, is relatively lightweight and self righting. The traffic cone includes a substantially conical hollow body with a specially configured base. The base extends from and surrounds the circular bottom of the cone and has a peripheral undulating edge to provide an alternating array of radially oriented flaps and grooves. The base is fabricated from an elastomeric synthetic resin, such as polyvinylchloride having a plasticizer, to be sufficiently elastic and flexible to bend and to return the traffic cone to the upright position after it has been subjected to an externally applied tipping force. An annular indentation in the undersurface of the base tends to restrict bending of the base along a generally straight line extending chordwise through the depression and radially inwardly of the flaps. The undulating peripheral edge of the base provides the base with sufficient diametric size to maintain one or more flaps in contact with the ground surface during the tipping and self righting movements.

Accordingly, it is a primary object of the present invention to provide a self righting traffic cone.

Another object of the present invention is to provide a light weight and portable traffic cone.

Yet another object of the present invention is to provide a traffic cone having a base with an undulating peripheral edge radially outwardly of an annular depression.

Still another object of the present invention is to provide a base for a traffic cone having an alternating array of radially protruding flaps and grooves radially outwardly of an annular depression.

A further object of the present invention is to provide an annular depression in the base of a traffic cone concentric with the cone portion for focusing the bend line of the base therethrough on tipping of the traffic cone.

A still further object of the present invention is to provide the base of a traffic cone with a plurality of radially oriented flaps and a predetermined bend line for the flaps upon tipping of the traffic cone.

A yet further object of the present invention is to provide a method for self righting a traffic cone.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Figure 1:
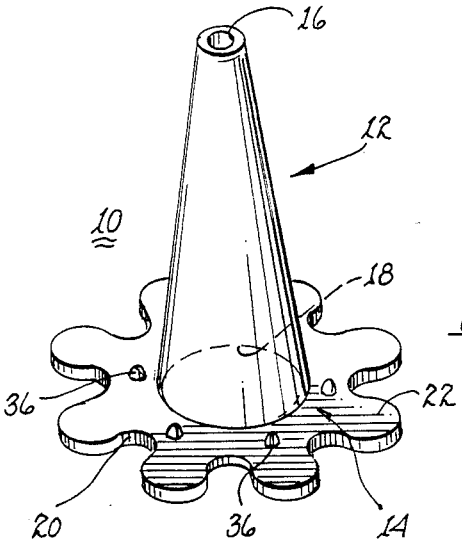
FIG. 1 is a perspective view of a self righting road marker or traffic cone.

As shown in FIG. 1, a road marker or traffic cone 10 includes an upright substantially conical body, cone 12, extending from a base 14. Cone 12 is a thin wall hollow structure of frustoconical configuration having a hole 16 in its upper end and defining a circular open bottom end 18. Cone 12 is preferably formed of a suitable lightweight semirigid synthetic resin, such as ethylene vinyl acetate. As an alternative, cone 12 can be formed of essentially the same material as base 14, which base has special characteristics. If the material of cone 12 is similar to the material of base 14, it should be lighter in weight and may include lighter weight filler than that of the base. Cone 12 is joined to the base by using a suitable adhesive to hold the base in place on a previously molded cone 12. Base 14 is integral with or attached to cone 12 and extends from open circular bottom end 18 in surrounding relationship therewith and disposed to lie in a plane normal to the longitudinal axis of the cone.

A principle object of the present invention is to provide traffic cone 10 with the ability to return to an upright position subsequent to it having been tipped over by an externally applied force, such as being struck by a motor vehicle, blown over by strong winds and the like. This objective is accomplished by a combination of physical characteristics and the special material used in forming base 14.

The base is fabricated from an elastomeric material to provide the base with flexibility and elasticity characteristics. These characteristics provide the base with an elastic memory to cause it to tend to return to its normal planar shape after being bent, deflected or otherwise forced out of its normal shape and disposition. A material which is suitable for this purpose is polyvinylchloride (PVC) formulated with a plasticizer along with other known constitutes, such as a heat stabilizer, ultraviolet inhibitor and the like.

As will be appreciated, traffic cones per se need to have a base which is large enough and heavy enough to maintain sufficient stability during normal use. In order for a traffic cone having an elastomeric base to possess the desired self righting characteristics, the base must be larger, i.e. have greater surface extent, in comparison with a traditional non self righting traffic cone, to provide what may be defined as an effective surface area of the base. The effective surface area of the base of the traffic cone is that portion, or area, of the base which remains in contact with the ground surface during tipping and subsequent self righting movements of the traffic cone.

Figure 2:
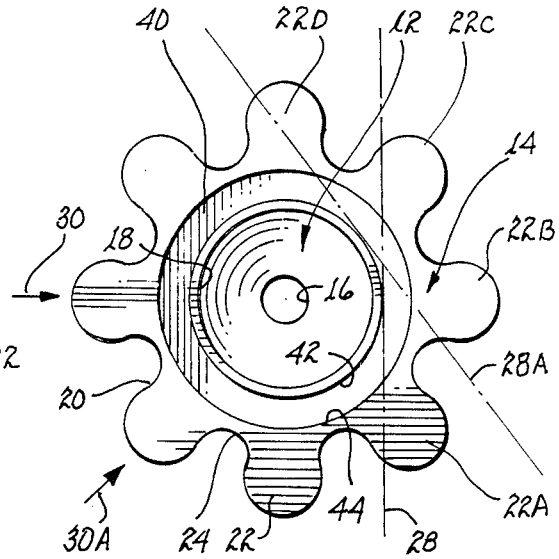
FIG. 2 is a bottom plan view of the traffic cone.

As shown in FIG. 2, base 14 is formed with an undulating peripheral edge 20, which edge provides traffic cone 10 with specific advantages relating to its stability, its self righting characteristics and its base to cone weight ratio. The undulating peripheral edge of base 14 forms an alternating array, or series, of radially protruding flaps 22 and grooves 24 which increase the effective surface area and effective diameter of the base without increasing its weight; alternatively, the undulating edge reduces the weight of the base without a loss of effective surface area. The undulating peripheral edge is shown as being of substantially sinusoidal configuration but it could be of other shapes, such as a square wave. The protruding radial flaps could be also formed with opposed substantially parallel side edges and an end edge having superimposed flaps and grooves.

Figure 3:
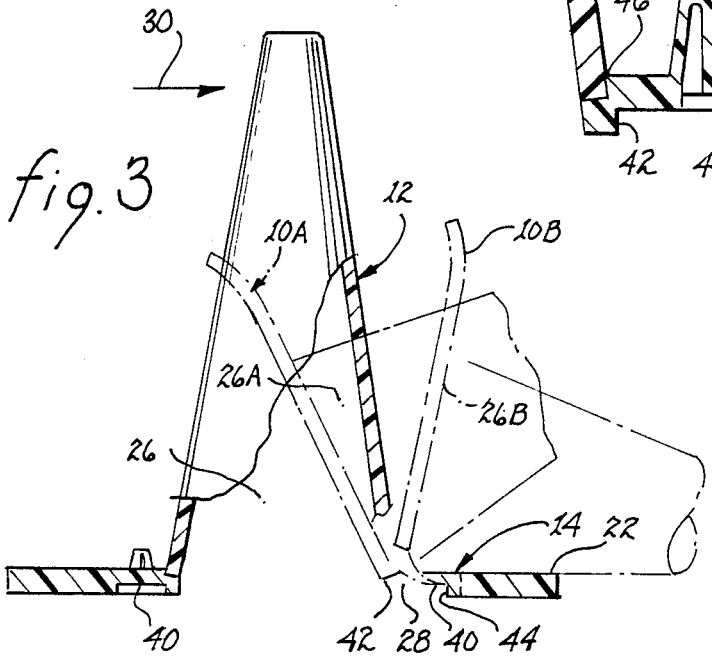
FIG. 3 is a side elevational view and showing the steps of tipping.
Figure 4:
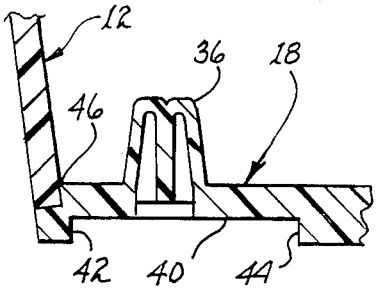
FIG. 4 is a fragmentary sectional view of the base of the traffic cone.

As shown jointly in FIGS. 3 and 4, base 14 includes an annular depression 40 formed in the bottom surface and defined by annular side walls 42,44. The depression is concentric with and encircles junction 46 between cone 12 and base 14. Necessarily, this depression reduces the thickness of the base coincident therewith. Any bending force applied to the base will tend to cause the base to bend along a line passing through depression 40 due to the commensurate reduced thickness of the base and resulting lessened resistance to bending; generally, this line will extend as a chord of side wall 44.

As shown in FIGS. 2 and 3, traffic cone 10 has a relatively low center of gravity 26 which will tend to move in an arcuate path about a pivot axis 28 when the traffic cone is subjected to a tipping force represented by arrow 30. Due to the elasticity and flexibility of base 14 in the vicinity of depression 40, the effective surface area which remains in contact with the ground surface will be that portion of the area of the base on the side of pivot axis 28 opposite to the applied tipping force and radial of the depression. It has been found that at least two, and preferably three, of radially protruding flaps 22 need to remain in ground surface engagement to provide an ideal amount of effective surface area of base 14. This can be achieved in the manner shown best in FIG. 2. When the tipping force is applied in the direction of arrow 30, flaps 22A, 22B and 22C will constitute the effective surface area of base 14 because they are disposed oppositely of the applied force, i.e. on the opposite side of the pivot axis 28. When the tipping force is applied in another direction as indicated by the force arrow 30A, pivot axis 28A will be moved appropriately with the direction change of the applied force and radial flaps 22B, 22C and a portion of flap 22D will make up the effective area of the base.

When the traffic cone is in a partially tipped over position, as indicated by dashed line position 10A, center of gravity 26 will shift into position 26A which is an "under center" position relative to pivot axis 28. In situations of this sort, gravity will return traffic cone 10A to its normal upright position. In instances where the tipping force is great enough to fully tip the traffic cone, as indicated by dashed line 10B, center of gravity 26B will move to an "over center" position relative to pivot axis 28. When fully tipped, radial flaps 22 which are diametrically opposed to the effective surface area of base 14, will bend back as shown, in the direction opposite to the applied tipping force. The bent back flaps 22 and the elastic memory, or resiliency, of the base cooperate to return the traffic cone 10 to its normal upright position.

Base 14 may be divided into two base portions, both of which are concentric with respect to the circular bottom end 18 of frustoconical cone 12. The first of these concentric base portions is an inner concentric area incorporating depression 40. The second concentric base portion is an outer area which includes alternating series of radial flaps 22 and grooves 24. In order for traffic cone 10 to have the necessary effective area wherein at least two and preferably portions of three of the flaps are in ground surface contact during tipping and self righting movements, it has been determined that eight equiangularly spaced flaps 22 accomplish that objective. Moreover, the eight flaps preferably constitute approximately half of the total area of the second or outer concentric portion of the base.

In addition to the foregoing, traffic cone 10 may also be provided with a plurality (six shown) of standoffs 36. The standoffs may be formed integrally with or suitably joined to base 14. The standoffs are disposed in circumferentially equally spaced increments in the first concentric base portion of the base and extend upwardly therefrom. Standoffs 36 have utility whenever traffic cones 10 are stacked, as is customary during storage and transport. Standoffs 36 will support and maintain separate the traffic cones in an upwardly spaced position to prevent sticking of the stacked traffic cones.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A self righting traffic cone for use on a ground surface as a marker, said traffic cone comprising in combination:

(a) a hollow cone having a top and a bottom;

(b) a bendable base engaging the bottom of said cone and extending radially outwardly therefrom for supporting said cone and for urging erection of said cone subsequent to tipping of said traffic cone, said base having a top surface and a bottom surface, said base including a plurality of radially protruding flaps interleaved with a plurality of radially oriented grooves to define an undulating peripheral edge in planform; and (c) a reduced thickness constant width annular depression disposed in the bottom surface of said base concentric with and radially outward of the bottom of said cone for inducing a bend line on said base upon tipping of said traffic cone which extends across said base in an intersecting relationship with said annular depression and for urging the flaps radially outwardly of the bend line to remain in planar contact with the supporting ground surface.

2. The self righting traffic cone as set forth in claim 1 wherein said depression includes a first sidewall concentric with the bottom of said cone and a second side wall outwardly radially displaced from said first side wall.

3. The self righting traffic cone as set forth in claim 1 wherein the bend line of said base defines a chord line extending across said depression.

4. The self righting traffic cone as set forth in claim 1 wherein said base is formed of polyvinylchloride having a plasticizer.

5. The self righting traffic cone as set forth in claim 1 wherein said base comprises a first concentric portion including said annular depression and a second concentric portion including said flaps and said grooves.

6. A self righting traffic cone as set forth in claim 1 wherein said undulating peripheral edge is defined by a sinusoidal configuration centered upon a circle concentric with said hollow cone.

* * * * *